US010357682B2

(12) United States Patent
Burkhardt

(10) Patent No.: US 10,357,682 B2
(45) Date of Patent: Jul. 23, 2019

(54) FLEXOR AND EXTENSOR EXERCISE DEVICE

(71) Applicant: Matthew Boyd Burkhardt, East Norwich, NY (US)

(72) Inventor: Matthew Boyd Burkhardt, East Norwich, NY (US)

(73) Assignee: Matthew Burkhardt, East Norwich, NY (US)

( * ) Notice: Subject to any disclaimer, the term of this patent is extended or adjusted under 35 U.S.C. 154(b) by 322 days.

(21) Appl. No.: 15/273,174

(22) Filed: Sep. 22, 2016

(65) Prior Publication Data

US 2017/0326408 A1 Nov. 16, 2017

Related U.S. Application Data

(60) Provisional application No. 62/336,844, filed on May 16, 2016.

(51) Int. Cl.

| | |
|---|---|
| ***A63B 21/00*** | (2006.01) |
| ***A63B 23/035*** | (2006.01) |
| ***A63B 21/068*** | (2006.01) |
| ***A63B 21/015*** | (2006.01) |
| ***A63B 21/06*** | (2006.01) |

(Continued)

(52) U.S. Cl.

CPC ..... *A63B 21/4047* (2015.10); *A63B 21/015* (2013.01); *A63B 21/068* (2013.01); *A63B 21/0618* (2013.01); *A63B 21/159* (2013.01); *A63B 21/4034* (2015.10); *A63B 21/4039* (2015.10); *A63B 21/4045* (2015.10); *A63B 23/0355* (2013.01); *A63B 23/03525* (2013.01); *A63B 23/03566* (2013.01); *A63B 21/00069* (2013.01); *A63B 21/22* (2013.01); *A63B 21/227* (2013.01); *A63B 21/4015* (2015.10); *A63B 21/4035* (2015.10); *A63B 22/208* (2013.01);

(Continued)

(58) Field of Classification Search

CPC . A63G 11/00; A63B 21/00069; A63B 21/015; A63B 21/0618; A63B 21/068; A63B 21/159; A63B 21/22; A63B 21/227; A63B 21/4015; A63B 21/4034; A63B 21/4035; A63B 21/4039; A63B 21/4045; A63B 21/4047; A63B 22/208; A63B 23/03525; A63B 23/0355; A63B 23/03566; A63B 2071/0072; A63B 2208/0233

See application file for complete search history.

(56) References Cited

U.S. PATENT DOCUMENTS 135,250 A * 1/1873 Smale ..... A63G 11/00 472/112

273,530 A * 3/1883 Hill ..... A63G 11/00 472/113

(Continued)

*Primary Examiner* — Joshua Lee

(57) ABSTRACT

An exercise device that exercises both flexor and extensor muscles is provided. The exercise device includes a base having a front end, a rear end, a first side and a second side. Protruding from the rear end of the base is an anchor bar. The anchor bar may be substantially perpendicular to the base. An overhead handle bar may be pivotally connected to the top of the anchor bar by a pivot point. A stationary fulcrum may be secured to opposing sides of the base. A rotating rod is secured to the stationary fulcrum and rotates about a horizontal axis running through the rotating rod and the fulcrum. A slant board is supported by and pivots about the rotating rod.

16 Claims, 5 Drawing Sheets

(51) Int. Cl.

| | |
|---|---|
| *A63B 71/00* | (2006.01) |
| *A63B 22/20* | (2006.01) |
| *A63B 21/22* | (2006.01) |

(52) U.S. Cl.

CPC ..... *A63B 2071/0072* (2013.01); *A63B 2208/0233* (2013.01)

(56) References Cited

U.S. PATENT DOCUMENTS

| | | | | |
|---|---|---|---|---|
| 9,162,099 | B2 | 10/2015 | Burkhardt | |
| 2014/0206512 | A1* | 7/2014 | Burkhardt | A63B 21/4034 482/145 |

* cited by examiner

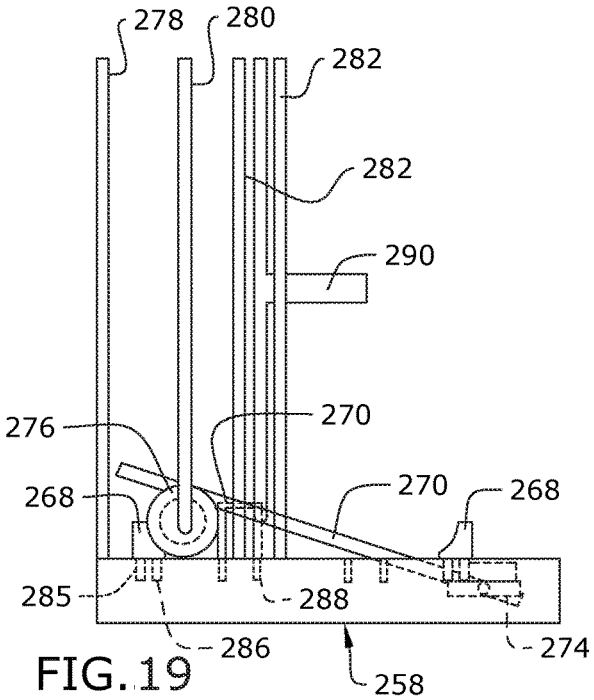
FIG. 19
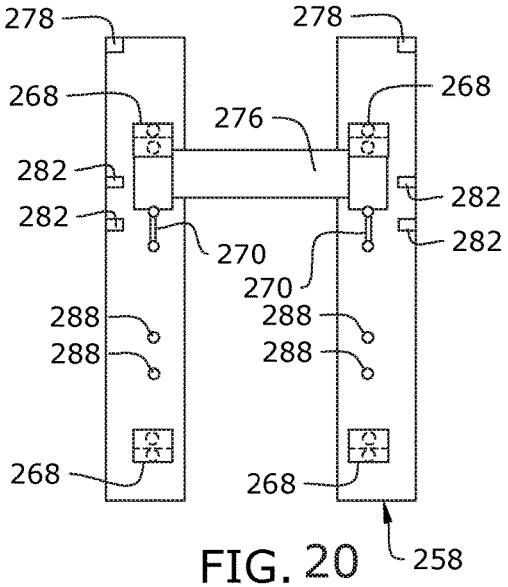
FIG. 20
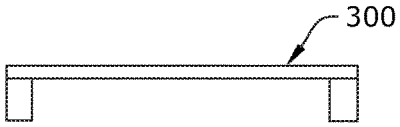
FIG. 21
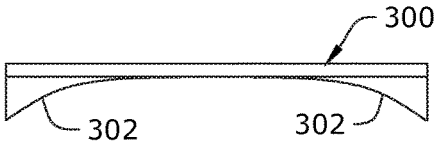
FIG. 22
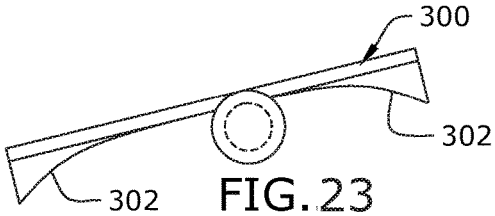
FIG. 23
FIG. 24
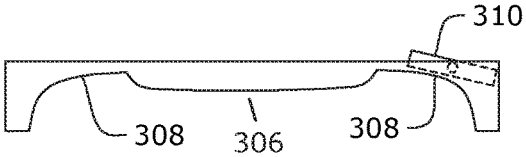

FLEXOR AND EXTENSOR EXERCISE DEVICE

CROSS-REFERENCE TO RELATED APPLICATION

This application claims the benefit of priority of U.S. provisional application No. 62/336,844, filed May 16, 2016 the contents of which are herein incorporated by reference.

BACKGROUND OF THE INVENTION

The present invention relates to an exercise device and, more particularly, to an exercise device that exercises both flexor and extensor muscles.

Currently, exercise machines generally fail to enable users to exercise both the flexor and extensor muscles. In order to exercise both flexor and extensor, a user may have to use two separate machines. However, some machines that do allow a user to exercise the flexor and extensor muscles are extremely expensive.

As can be seen, there is a need for a less expensive machine that exercises the flexor and extensor muscles.

SUMMARY OF THE INVENTION

In one aspect of the present invention, an exercise device comprises: a base comprising a front end, a rear end, a first side and a second side; a fulcrum fixed to the first side and the second side of the base; a rotating cylinder supported by the fulcrum and rotatable relative to the fulcrum about a horizontal axis running from the first side to the second side; at least one slant board supported by and pivotable about the rotating cylinder; and a seat support disposed above the at least one slant board and comprising a seat.

In another aspect of the present invention, an exercise device comprises: a base comprising a front end, a rear end, a first side and a second side; an anchor bar protruding from the rear of the base; an overhead handle bar pivotally attached to the anchor bar; a fulcrum fixed to the first side and the second side of the base, wherein the fulcrum is adjustable to be fixed at the front end or the rear end of the base; a rotating cylinder supported by the fulcrum and rotatable about a horizontal axis running from the first side to the second side; at least one slant board supported by and pivotable about the rotating cylinder; and a seat support attached to the exercise device and comprising a seat.

These and other features, aspects and advantages of the present invention will become better understood with reference to the following drawings, description and claims.

BRIEF DESCRIPTION OF THE DRAWINGS

FIG. 19 is a side view of an alternate embodiment of the present invention shown in an exemplary tertiary configuration;

FIG. 20 is a top view of an alternate embodiment of the present invention shown in an exemplary tertiary configuration;

FIG. 21 is a front view of an alternate embodiment of the present invention;

FIG. 22 is a side view of an alternate embodiment of the present invention;

FIG. 23 is a side view of an alternate embodiment of the present invention shown in exemplary usage; and FIG. 24 is a side view of an alternate embodiment of the present invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an exercise device that exercises both flexor and extensor muscles. The exercise device includes a base having a front end, a rear end, a first side and a second side. Protruding from the rear end of the base is an anchor bar. The anchor bar may be substantially perpendicular to the base. An overhead handle bar may be pivotally connected to the top of the anchor bar by a pivot point. A stationary fulcrum may be secured to opposing sides of the base. A rotating rod is secured to the stationary fulcrum and rotates about a horizontal axis running through the rotating rod and the fulcrum. A slant board is supported by and pivots about the rotating rod.

Figure 1:
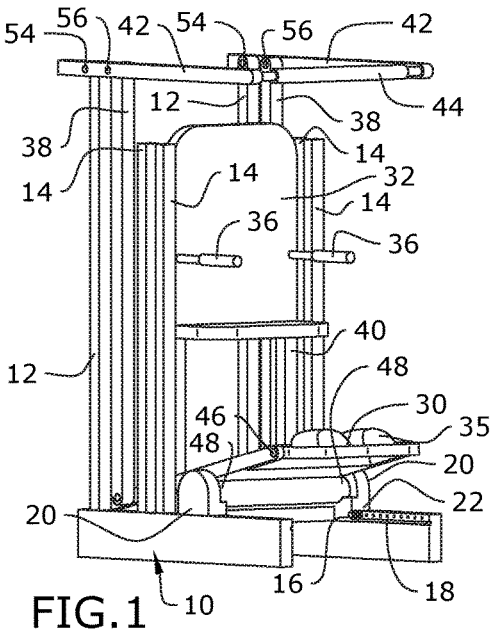
FIG. 1 is an upper perspective view of the present invention.
Figure 2:
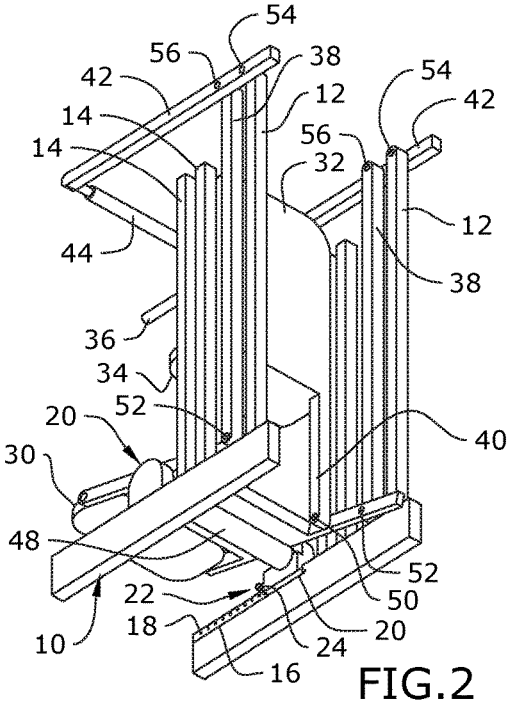
FIG. 2 is a lower perspective view of the present invention.
Figure 3:
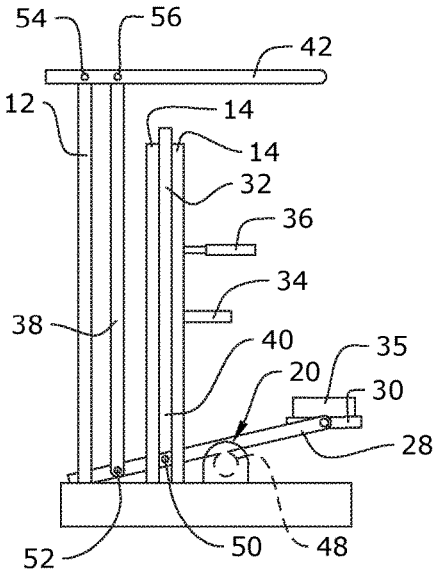
FIG. 3 is a side view of the present invention shown in an exemplary position.
Figure 4:
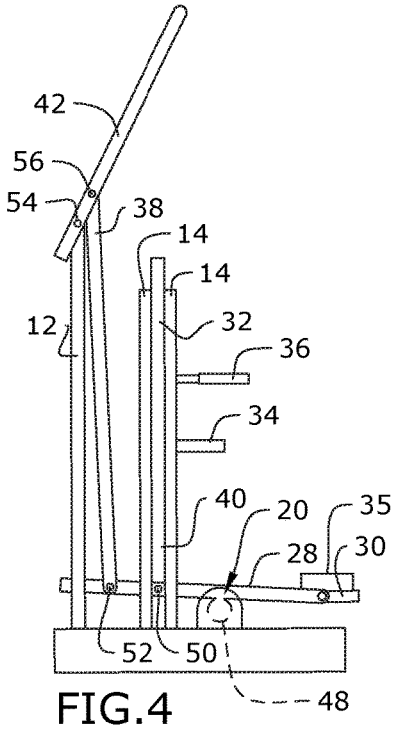
FIG. 4 is a side view of the present invention shown in an exemplary secondary position.
Figure 5:
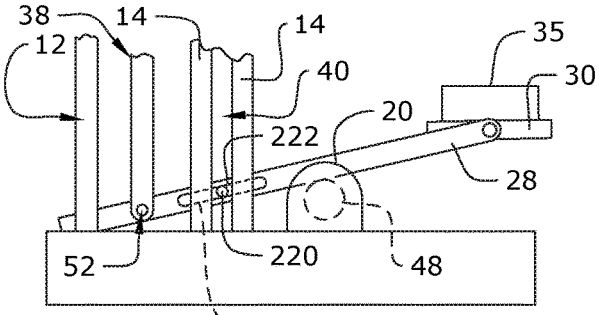
FIG. 5 is a side view of an alternate embodiment of the present invention shown in an exemplary initial state.
Figure 6:
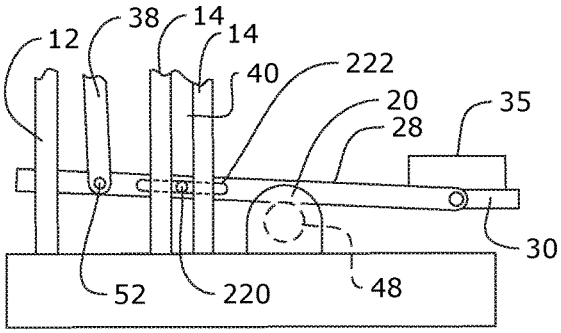
FIG. 6 is a side view of an alternate embodiment of the present invention shown in an exemplary secondary state.
Figure 7:
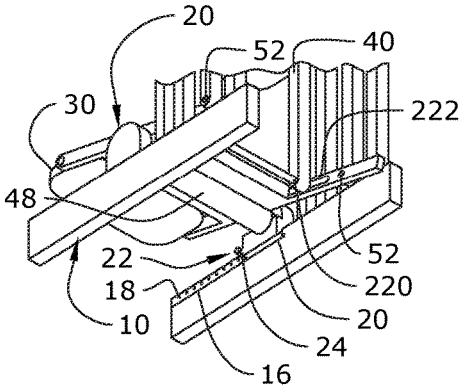
FIG. 7 is a detail lower perspective view of an alternate embodiment of the present invention.
Figure 8:
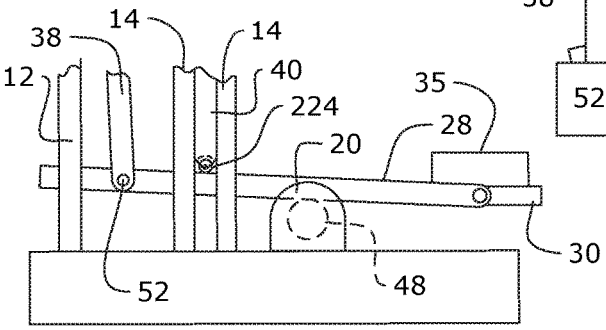
FIG. 8 is a side view of an alternate embodiment of the present invention shown in an exemplary initial state.
Figure 9:
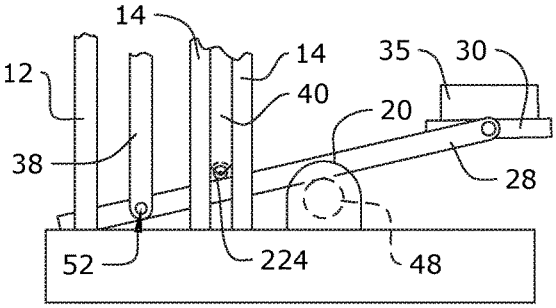
FIG. 9 is a side view of an alternate embodiment of the present invention shown in an exemplary secondary state.
Figure 10:
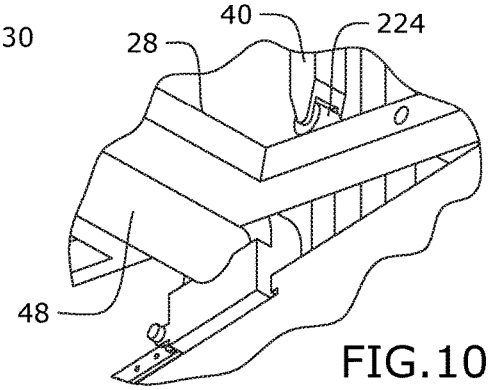
FIG. 10 is a detail lower perspective view of an alternate embodiment of the present invention.
Figure 12:
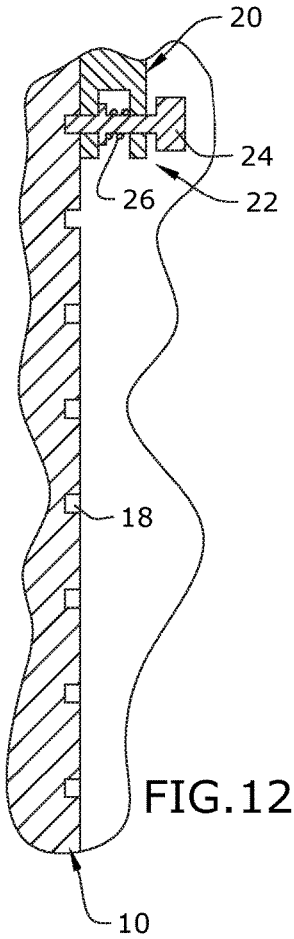
FIG. 12 is a section detail view of the present invention along line 12-12 in FIG. 11.
Figure 11:
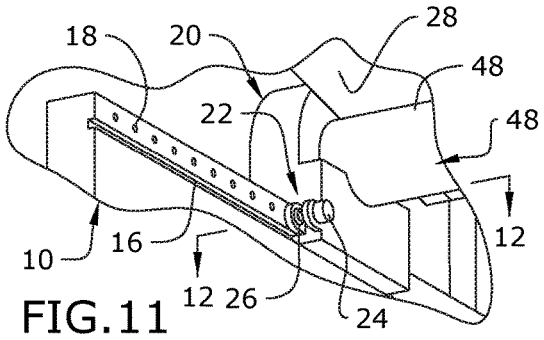
FIG. 11 is a lower perspective detail view of the present invention.
Figure 14:
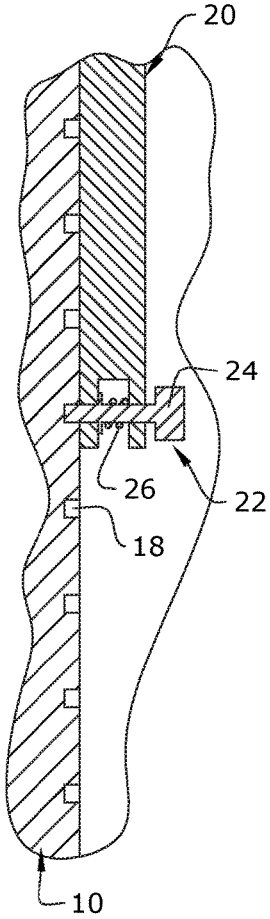
FIG. 14 is a section detail view of the present invention along line 14-14 in FIG. 13.
Figure 13:
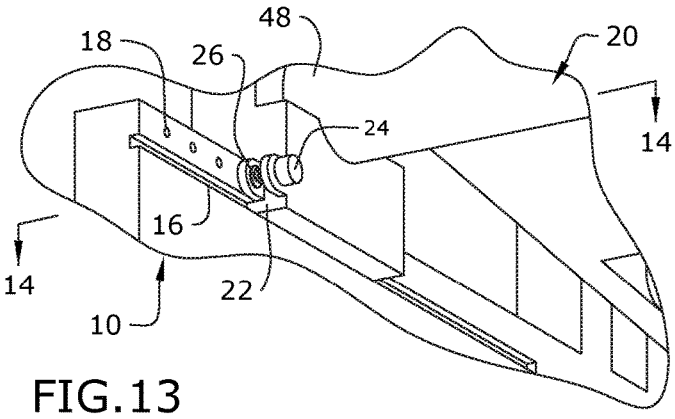
FIG. 13 is a lower perspective detail view of the present invention.

Referring to FIGS. 1 through 14, the present invention may include an exercise machine with a base 10 having a front end, a rear end, a first side and a second side.

Protruding from the rear end of the base 10 is an anchor bar 12. The anchor bar 12 may be substantially perpendicular to the base 10. An overhead handle bar 42, 44 may be pivotally connected to the top of the anchor bar 12 by a pivot point 54. A stationary fulcrum 20 may be secured to opposing sides of the base 10. A rotating rod 48 is secured to the stationary fulcrum 20 and rotates about a horizontal axis running through the rotating rod 48 and the fulcrum 20. The rotating rod 48 may rotate about a bearing.

The present invention may further include a slant board 28. The slant board 28 may be located above the base 10. The slant board 28 pivots on top of the rotating rod 48, similar to a see saw. The slant board 28 may pivot towards the front end and away from the rear end and pivot towards the rear end and away from the front end. In certain embodiments, a footpad 30 may be at the front end of the slant board 28. In certain embodiments, the footpad 30 may connect to the slant board 28 by a pivot point 46 and thereby the footpad 30 may pivot with respect to the slant board 28. The footpad 30 may include foot straps 35 sized to receive a foot within. The slant board 28 may be in a planar or a non-planar shape such as a concave/convex fashion.

In certain embodiments, a seat support 40 may be connected to the exercise device. For example, as illustrated in the Figures, the seat support 40 may be connected near the rear of slant board 28 by a pivot point 50. The seat support 40 may include a seat back 32, a seat 34 and at least one handle peg 36. However, the handle peg 36 may be located and attached directly to the slant board 20, and thereby be in front of a user. In certain embodiments, the present invention may further include a support frame 14. The support frame 14 may be secured to the base 10 and extend vertically therefrom. The seat support 40 may be disposed within the support frame 14 and slides up and down within the support frame 14 when the exercise device is in use. The support frame 14 vertically guides the seat support 40 while the seat support 40 moves up and down.

The seat support 40 may be in a different configuration to serve a similar purpose. For example, a bottom end of the seat support 40 may include a peg 220 that fits within a slot 222 formed within the slant board 20. The peg 220 may protrude beyond a gap formed in the support frame 14. Therefore, the peg 220 may slide within the slot 222 of the slant board 28 and a gap of the support frame 14, allowing the slant board 28 to rotate relative to the seat support 40. In alternate embodiments, the bottom of the seat support 40 may include a roller 224 that rolls along a top surface of the slant board 28. This configuration also allows the slant board 28 to rotate relative to the seat support 40. Since the slant board 28 is able to rotate relative to the seat support 40, the seat support 40 may maintain a vertical position while the present invention is in use.

Behind the seat support 40 and attached to the slant board 20 may be a connecting bar 38. The connecting bar 38 may be connected to the slant board 20 by a pivot point 52. In certain embodiments, the connecting bar 38 may protrude upwards. The connecting bar 38 may connect to the overhead handle bars 42, 44 at the top end by a pivot point 56. The overhead handle 42, 44 includes handle bars 42 and a handle 44 connecting the handle bars 42 together at a front end.

The fulcrum 20 and the rotating rod 48 are in a fixed position relative to the base 10. In certain embodiments, the fulcrum 20 and the rotating rod 48 may be moved from the fixed position on the base to another fixed position from the front end to the rear end. For example, if the user prefers to limit their resistance to extending only, the fulcrum 20 and the rotating rod 48 may be positioned in front of the seat 34. If the user prefers to limit their resistance to flexing only, the fulcrum 20 and the rotating rod 48 may be positioned behind the seat 34.

To move the fulcrum 20 and the rotating rod 48, a lower portion of the fulcrum 20 may slidably engage within a channel 16 formed from the front to the rear of an inner surface of the base 10. The fulcrum 20 may include a fulcrum pin bracket 22 having a pin 24 that is biased by a spring 26 into notches 18 formed along the channel 16 of the base 10. To move the fulcrum 20 from one fixed position to another, the pin 24 may be pulled out of an aligning notch 18. The fulcrum 20 may slide to a desired position from the front end to the rear end of the base 10. The pin 24 is then released into another aligning notch 18 and the fulcrum 20 is fixed in a new position.

Figure 15:
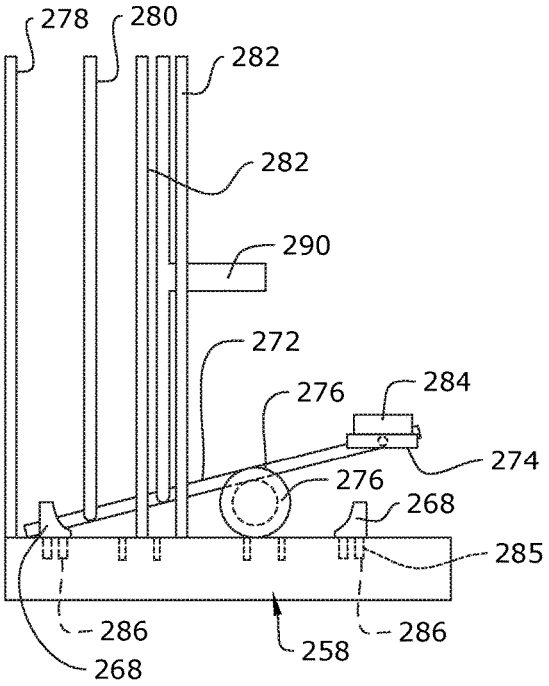
FIG. 15 is a side view of an alternate embodiment of the present invention shown in an exemplary initial configuration.
Figure 17:
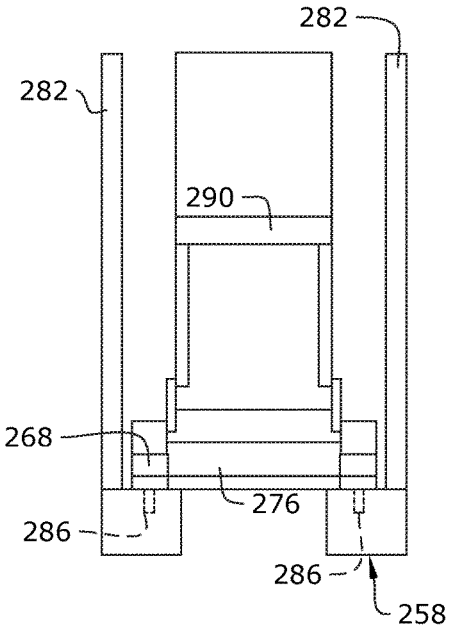
FIG. 17 is a front view of an alternate embodiment of the present invention shown in an exemplary secondary configuration.
Figure 16:
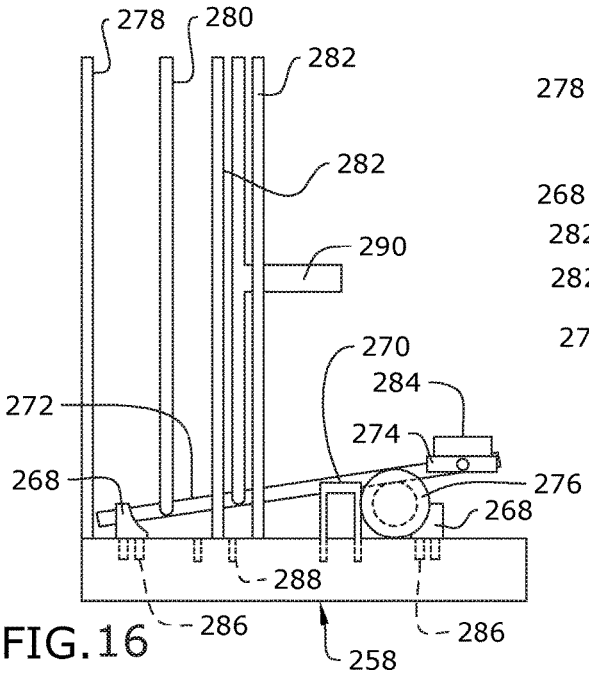
FIG. 16 is a side view of an alternate embodiment of the present invention shown in an exemplary initial configuration.
Figure 18:
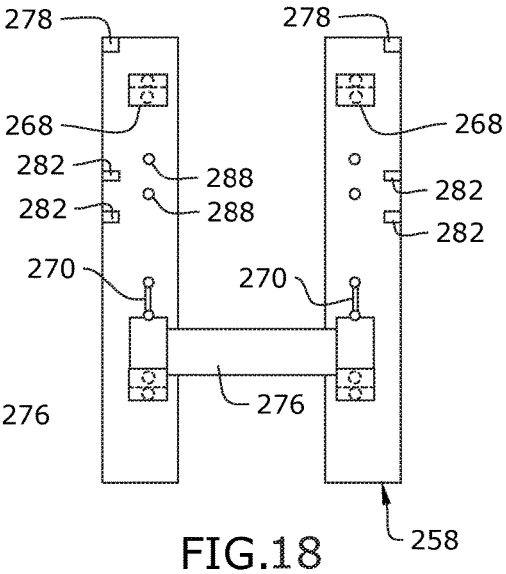
FIG. 18 is a top view of an alternate embodiment of the present invention shown in an exemplary secondary configuration.

As illustrated in FIGS. 15 through 20, similar to the above embodiment, the present invention may include a base 258, an anchor bar 278, a connecting bar 280, a support frame 282, a seat 290, a slant board 272, a foot board 274, foot straps 284, and a fulcrum 276. The fulcrum 276 may be fixed to the base 258 in the front and the rear. In such embodiments, the present invention may include chock pin holes 285 at the front and rear end of the base 258. Chock pins 286 extending from chocks 268 may fit within the chock pin holes 285. Stopper holes 288 may be disposed adjacent the chock pin holes 288 at the front end and at the rear end. A stopper bracket 270 may fit within the stopper holes 288. When fixing the fulcrum 276 at the front end, the stopper bracket 270 may be secured within the stopper holes 288 near the front end and the fulcrum 276 is disposed in between the stopper bracket 270 and a front chock 268. When fixing the fulcrum 276 at the rear end, the stopper bracket 270 may be secured within the stopper holes 288 near the rear end and the fulcrum 276 is disposed in between the stopper bracket 270 and a rear chock 268.

FIGS. 21 through 24 illustrate show other versions of slant board profiles which work with some embodiments. The slant board 300 has slant board ramps 302 on its underside and a rocker foot board 310 at the front end. These ramps 302 serve to slow the movement of the fulcrum cylinder 48 at either end of its movement. FIG. 26 shows a version that has slant board ramps 308 and rocker bottoms 306. In this version, the fulcrum cylinder 48 is slowed by the ramps 308, and its rocker bottoms 306 allow for more slant board pivot at the finishing ends of either the flexion or extension movements.

It should be understood, of course, that the foregoing relates to exemplary embodiments of the invention and that modifications may be made without departing from the spirit and scope of the invention as set forth in the following claims.

What is claimed is:

1. An exercise device comprising:

a base horizontally disposed and comprising a front end, a rear end, a first side and a second side;

a fulcrum fixed to the first side and the second side of the base;

a rotating cylinder supported by the fulcrum and rotatable relative to the fulcrum about a horizontal axis, wherein the rotating cylinder extends from the first side to the second side;

at least one slant board disposed on top of and pivotable about the rotating cylinder;

a support frame secured to the base and extending vertically therefrom;

a seat support disposed vertically relative to the base and slidably engaged within the support frame, wherein the slant board is pivotal relative to the seat support; and a seat coupled to the seat support, wherein the support frame guides the seat support to slide in an up and down vertical direction relative to the base when the at least one slant board pivots about the rotating cylinder.

2. The exercise device of claim 1, further comprising an overhead handle bar attached to the exercise device.

3. The exercise device of claim 2, further comprising an anchor bar protruding from the rear of the base, wherein the overhead handle bar is pivotally attached to the anchor bar.

4. The exercise device of claim 3, further comprising a connecting bar comprising a top end and a bottom end, wherein the bottom end is connected to a rear portion of the slant board by a first pivot point and the top end is connected to the overhead handle bars by a second pivot point.

5. The exercise device of claim 1, further comprising at least one handle peg attached to the seat support.

6. The exercise device of claim 1, wherein the seat support is pivotally secured to the slant board.

7. The exercise device of claim 1, further comprising a footpad pivotally attached to the front end of the slant board.

8. The exercise device of claim 7, further comprising at least one foot strap attached to the footpad.

9. The exercise device of claim 1, wherein the fulcrum is adjustable to be fixed at the front end or the rear end of the base.

10. The exercise device of claim 9, wherein a lower portion of the fulcrum is slidably engage within a channel formed from the front end to the rear end the base.

11. The exercise device of claim 10, wherein a plurality of notches are formed in the base along the channel.

12. The exercise device of claim 10, further comprising a fulcrum pin bracket secured to the fulcrum, wherein the fulcrum pin bracket comprises a pin that is biased by a spring into one of the plurality of notches formed along the channel of the base.

13. The exercise device of claim 1, wherein the seat support further comprises rollers that engage a top surface of the slant board.

14. An exercise device comprising:

a base horizontally disposed and comprising a front end, a rear end, a first side and a second side;

an anchor bar protruding from the rear of the base;

an overhead handle bar pivotally attached to the anchor bar;

a fulcrum fixed to the first side and the second side of the base, wherein the fulcrum is adjustable to be fixed at the front end or the rear end of the base;

a rotating cylinder supported by the fulcrum and rotatable about a horizontal axis, wherein the rotating cylinder extends from the first side to the second side;

at least one slant board disposed on top of and pivotable about the rotating cylinder;

a support frame secured to the base and extending vertically therefrom;

a seat support disposed vertically relative to the base and slidably engaged within the support frame, wherein the slant board is pivotal relative to the seat support; and a seat coupled to the seat support, wherein the support frame guides the seat support to slide in an up and down vertical direction relative to the base when the at least one slant board pivots about the rotating cylinder.

15. The exercise device of claim 14, further comprising a connecting bar comprising a top end and a bottom end, wherein the bottom end is connected to a rear portion of the slant board by a first pivot point and the top end is connected to the overhead handle bar by a second pivot point.

16. The exercise device of claim 14, wherein the seat support further comprises rollers that engage a top surface of the slant board.

* * * * *